US006292134B1

(12) United States Patent
Bondyopadhyay

(10) Patent No.: US 6,292,134 B1
(45) Date of Patent: Sep. 18, 2001

(54) GEODESIC SPHERE PHASED ARRAY ANTENNA SYSTEM

(76) Inventor: Probir K. Bondyopadhyay, 14.418 Oak Chase Dr., Houston, TX (US) 77062

( * ) Notice: Subject to any disclaimer, the term of this patent is extended or adjusted under 35 U.S.C. 154(b) by 0 days.

(21) Appl. No.: 09/513,014

(22) Filed: Feb. 25, 2000

Related U.S. Application Data

(60) Provisional application No. 60/121,874, filed on Feb. 26, 1999.

(51) Int. Cl.[7] ..... H01Q 3/02; H01Q 3/12

(52) U.S. Cl. ..... 342/374

(58) Field of Search ..... 342/368–384

(56) References Cited

U.S. PATENT DOCUMENTS 5,386,953 * 2/1995 Stuart ..... 244/158 R
5,457,465 * 10/1995 Collier et al. ..... 342/374

* cited by examiner

*Primary Examiner*—Thomas H. Tarcza
*Assistant Examiner*—Fred H. Mull
(74) *Attorney, Agent, or Firm*—Marvin J. Marnock

(57) ABSTRACT

A geodesic sphere phased array antenna system, capable of scanning the entire omni-directional communication space and comprising substantially equilateral triangular planar subarrays of antenna elements arranged in a geodesic sphere configuration. Icosahedron, one of the five regular solids and truncated icosahedron, one of the fifteen semi-regular solids are the preferred basis of the geodesic sphere phased array construction. The entire communication space is considered as subdivided into a large number of smaller cells and corresponding to each such cellular communication space, a contiguous set of the subarrays is energized and electronically phased to scan the cellular space. Another contiguous set of subarrays is energized and electronically phased to scan another cellular space in a similar manner resulting in limited angle scanning requirements which permit the basic antenna elements to be connected in a cluster as a unit building block to which transmit/receive signal distribution and processing means are connected resulting in lower costs in deployment, operation and maintenance.

30 Claims, 14 Drawing Sheets

GEODESIC SPHERE PHASED ARRAY ANTENNA SYSTEM

This application claims the benefit of U.S. Provisional Application Ser. No. 60/121,874, filed Feb. 26, 1999.

FIELD OF THE INVENTION

This invention relates, in general, to phased array antennas which provide hemispherical or wider coverage for multi-satellite communications and more particularly to a phased array antenna mounted on a geodesic sphere and adapted for multi-band communications with satellites in earth orbits including low earth orbits, medium earth orbits, and geo-stationary orbits.

BACKGROUND OF THE INVENTION

In the information age, present and beyond, explosive needs to communicate globally are causing accelerated growth in the deployment of communication satellites in the Low Earth Orbit(LEO), Medium Earth Orbit(MEO) as well as in the Geosynchronous Orbits(GEO). The need to constantly track and communicate with increasingly larger number of satellites by earth stations, stationary as well as mobile, demands development of efficient affordable phased array antennas capable of hemispherical or wider coverage scanning the entire sky and tracking multiple satellites both LEO, MEO and GEO, and continuously communicating two ways at multiple frequency bands. Invention of a new kind of affordable conformal phased array antenna capable of multiple beam, multiple band, multiple satellite communications is described here.

There exists a special equatorial circular orbit around the earth at the height of 22,300 miles, known as the geosynchronous or geostationary orbit, whose time period is equal to that of the rotation of the earth around its own axis. Therefore, an artificial satellite placed in that orbit will appear stationary from the surface of the earth.

Accordingly, the satellites in this special orbit do not have to be tracked and the focus of attention so far has been mainly directed to efficient and reliable communications with satellites in this special orbit. Because this orbit is 22,300 miles from earth, considerably large amount of transmit power have to be expended from the earth station as well as from the satellite to establish and maintain the two-way communication links.

Research, development and deployment of phased array antennas have received tremendous amounts of attention in the past fifty years in connection with radar systems and communication needs for mostly defense and some commercial applications. A phased array antenna is an array of antenna elements connected with a feed structure that energizes each element of the array with electromagnetic signals of appropriate amplitude and phase so as to form a beam in a chosen direction or a plurality of such beams in multiple directions so as to provide one-way or two-way communications. Hemispherical or wider communication coverage by phased array antenna systems has been realized by means of a multiple of planar phased array antennas placed on the faces of a pyramid or frustum of a pyramid with each planar phased array providing communication coverage to a segment of the hemisphere. The minimum number of required phased arrays is three whereas five planar arrays are often considered to be optimum. (For example, see G. H. Knittel, "Choosing the Number of Faces of a Phased Array Antenna for Hemisphere Scan Coverage", *IEEE Transactions on Antennas and Propagation*, Vol. AP-13, No. 11, November 1965, pp. 878–882). Because of the fact that every antenna element of the planar phased array has to be provided with a transmit unit and a receive unit with their associated control electronics containing amplifiers and other signal processing capabilities for simultaneous transmission and reception of electromagnetic beams, the phased array antenna systems are very expensive to manufacture and deploy. It is the prohibitive cost alone that has so far kept the phased array antenna system from playing its well deserved important role in the commercial arena.

However, driven by the defense needs of the past fifty years, many useful, albeit costly phased array antenna systems that are capable of providing hemispherical communication coverage have been proposed, designed, built, experimentally tested and deployed.

In U.S. Pat. No. 3,755,815, Stangel and Valentino described a Dome Lens phased array antenna system where in a planar phased array is capable of scanning the entire hemisphere or more by means of a feed-through hemispherical dome lens of antenna elements with fixed phase shifters, placed over the planar phased array. In this system, the planar phased array antenna in the diametric base plane, by itself, is capable of providing electronic scan coverage over approximately a conical space 60° off-broadside. The dome lens placed over it then, by the principle of refraction, should be able to stretch that coverage over the entire hemisphere. However, such an array system will have significant beam distortions at lower elevation angles with associated polarization coupling and severe impedance matching and power loss problems. The system is costly to build and because of the lack of modularity in construction, fault repair will be expensive.

In U.S. Pat. No. 4,458,249 Valentino and Stangel described another lens array system for hemispherical coverage. In that dual lens array system, the first microwave lens is a three dimensional focal ring bootlace lens that is a figure of revolution as opposed to a planar phased array in their earlier patent mentioned above. This lens array is covered by a non-planar lens array dome or dielectric dome cover with an elevation angle dependent refractive index profile to provide the refractive effect necessary to extend the coverage to the full hemisphere and beyond. This dual lens system is electromagnetically coupled to a feed array matrix capable of providing a plurality of beam ports and in one embodiment may comprise electromagnetic horn antennas. The resulting total antenna system is very costly to build specially where large antenna gain at lower microwave frequencies(1 GHz—10 GHz) is required. Because proximity coupling of three subsystems are involved, impedance matching of the three systems through enclosed structures is a formidable experimental task and undesirable polarization coupling will be difficult to control. Also, because of the lack of modularity, fault diagnostics and corrections are more invasive and difficult.

In U.S. Pat. No. 5,543,811, Chethik have described a phased array system for hemispherical coverage by means of three large planar phased arrays placed on the three faces of a triangular pyramid wherein the base and height of the pyramid are chosen such that the antenna system provides higher gains at lower elevation angles to compensate for additional propagation loss and rain-related losses suffered in the commercially used frequency band of 20 GHz. Although there is nothing new disclosed in terms of the phased array antenna itself and the means of covering the hemispherical communication space, what is new are the details about the phased array antenna placement and orientations with respect to the horizon so that the specific loss compensation related needs at the desired frequency range can be correctly addressed.

One of the important operational requirements of the phased array antenna systems for satellite communications is multi-beam formation for multi-satellite tracking and communications. For satellite based phased array antenna systems, Sreenivas in U.S. Pat. No. 5,821,908 describes a phased array antenna which uses a spherical lens for microwave beam collimation. Using multiple spherical lenses and multiple phased array feeds, multiple beams could thereby be generated. However, as Valentino and Stangel had already pointed out in their U.S. Pat. No. 4,458,249, Sreenivas's system is not suitable for hemispherical coverage because of aperture blockage. Furthermore, at the lower end of the microwave frequency bands where the dimensions are relatively large, in the order of meters for accurate satellite tracking and communication, fabricating a spherical lens with radially variable dielectric constants will be very expensive.

The above discussion leads to the observation that there is a need for a low cost phased array antenna system, in the earth stations for satellite communications, capable of providing hemispherical or wider coverage. In order to reduce life cycle costs, there is a need for the phased array antenna to be modular in construction so that fault detections and corrections could be done easily by simple replacement of the bad module with a new good one. It is the primary objective of this invention to address these needs.

It is to be appreciated that the relative ability of the phased array antenna output power to form a beam in a given direction compared to every other direction with reference to the input power, defined as the antenna gain, makes narrower beam widths possible. However, narrower beam widths require larger arrays and the Transmit/Receive Units associated with each antenna element constitute approximately 40% of the Phased Array Antenna fabrication cost. The reduction of numbers of required T/R units by means of grouping the basic antenna elements is an important aspect of the low cost design that needs to be considered.

Advantages of small angle scanning afforded by a direction dependent phased array constituted with swichable element units and subarrays, are needed to be considered to reduce the cost of construction and operation of phased array antenna systems.

Phased array antennas with omni-directional scanning capabilities that can be deployed as a satellite in the low earth orbit to observe important events like ballistic missile launches and tracking, and have simultaneous communications with earth stations as well as other satellites in various kinds of orbits and altitudes are of great importance as well.

It is the main objective of the present invention to create a low cost phased array antenna architecture that will provide communication coverage over the entire hemisphere. Embedded in this primary objective is the need to reduce the number of transmit/receive units required by the phased array by grouping basic antenna elements of the array and forming clusters to which the T/R units are to be connected. It is another important objective of the present invention to do away with curved lines and surfaces in the construction of the phased array antenna so as to reduce the cost of construction. Still another important objective of the present invention is to create a highly modular phased array antenna structure so that failures and damages in the system can be easily detected, removed, and replaced more easily so that down time and life cycle costs are reduced substantially.

SUMMARY OF THE INVENTION

The present invention is a Phased Array Antenna for tracking and communication with one or multiple satellites in all kinds of earth orbits anywhere in the entire sky is described. The phased array antenna comprises a plurality of substantially equilateral triangular-shaped planar subarray units arranged in a geodesic sphere configuration derived from a regular or semi-regular polyhedron and mounted on a geodesic structure of corresponding configuration. The icosahedron, which is a regular polyhedron, and a Platonic solid, is one of the preferred basic configurations of the present invention and the truncated icosahedron, which is a semi-regular polyhedron and an Archimedian solid, is another preferred basis in the invention. Each subarray of planar antenna elements is connectable to a signal feed means for forming at least one electromagnetic beam in space, either by itself or in combination with a plurality of adjacent subarrays. Considering communication space to be divided into a number of smaller cellular communication spaces, a subset of adjacent subarrays is connected to a feed-line structure which provides means for energizing the subarrays with appropriate amplitude and and relative phase distributions among the antenna elements so as to produce an electromagnetic beam for communication and tracking within the particular cellular space. For communicating and tracking within another cellular communication space, a different subset of adjacent subarrays can be energized to produce another electromagnetic beam either simultaneously therewith or in sequence thereto. The subdivision of communication space into a large number of smaller cells is a controlling guideline in design of the invention which results in limited scanning requirements for the geodesic sphere phased array. This situation allows antenna elements to be grouped as 2×2 cluster(or larger size) which forms a basic element to be used as the unit building block to which the individual transmit/receive units are connected. This allows realization of a desired wide angle communication capability for the antenna without producing undesirable grating lobes that might allow disruptive cross communication or spurious communications from or to other directions not permitted. In addition, substantially lower cost of construction and lower life cycle costs result from the fact that the phased array antenna structure is modular in construction and transmit/receive units for simultaneous two way communications need be provided to only a 2×2 element cluster instead of to each individual basic antenna elements.

BRIEF DESCRIPTION OF THE DRAWINGS

FIG. 2(*b*) is a schematic of a module of a subarray of antenna elements in the geodesic sphere phased array antenna of the invention and wherein a Transmit/Receive module is connected to each antenna element through a feed structure;

FIG. 3(*b*) is a schematic perspective view of a hemisphere surrounding a 3-face array of antenna elements as shown in FIG. 3(*a*) with illustrations thereon to show the scan requirements for the 3-face array;

FIG. 4(*b*) is a schematic perspective view of a hemisphere surrounding a 5-face array of antenna elements with illustrations thereon to show the scan requirements for the 5-face array of FIG. 4(*a*) and wherein one face has its normal at zenith and the other four faces have their normals 72° below zenith;

FIG. 5(*b*) is an illustration of a sphere derived from the icosahedron of FIG. 5(*a*);

FIG. 6(*b*) is a view of the geodesic sphere created by the procedure as illustrated by FIG. 6(*a*);

FIG. 6(*c*) is a schematic illustration of an equilateral triangular side of the icosahedron of FIG. 5(*a*) showing the division of a triangular side into a plurality of triangles;

FIG. 9(*b*) is a schematic diagram of the element unit arrangement in one of the planar triangular subarray panels of FIG. 9(*a*);

FIG. 10(*b*) is a schematic top view of cluster of four dual-band dual-circular polarized antenna elements as are connected to the feed network shown in FIG. 10(*a*);

FIG. 11(*b*) is a schematic diagram of a four element microstrip antenna array with microstrip feed lines connected thereto whereby the antenna produces left circularly polarized radiation;

FIG. 12(*b*) is a partial illustration of a geodesic sphere based on the truncated icosahedron wherein each of the 12 pentagons and 48 hexagons are further subdivided into triangular regions with the apexes of the subdivided triangular regions pushed outwards transposing on to the circumscribing sphere.

FIG. 13(*b*) is an illustration of a snub icosidodecahedron which can be used as a geodesic sphere structure in a further embodiment of the phased array antenna of the invention; and FIG. 13(*c*) is an illustration of an icosidodecahedron which can be used as a geodesic sphere structure in still another embodiment of the phased array antenna of the invention.

DETAILED DESCRIPTION OF THE INVENTION

Figure 1:
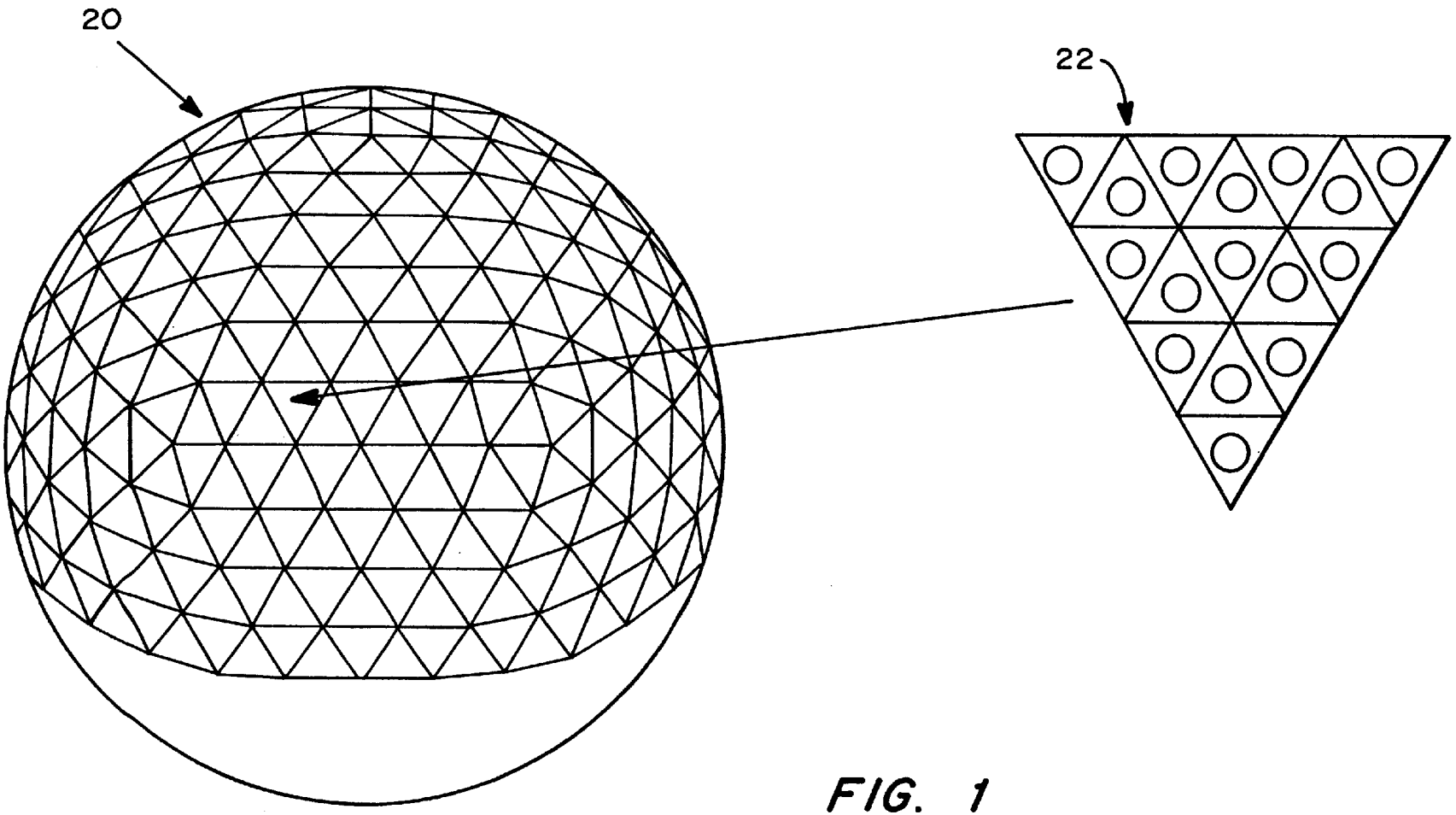
FIG. 1 is an exploded view showing a phased array antenna of the present invention which comprises substantially equilateral triangular-shaped subarrays of antenna elements mounted on the faces of a geodesic sphere structure with one of the triangular subarrays broken away and enlarged for purposes of illustration.

The present invention, is a geodesic sphere geodesic sphere phased array antenna such as the antenna structure 20 shown in FIG. 1. It comprises N number of substantially equilateral triangular shaped subarrays 22 of antenna elements arranged in the configuration of a geodesic sphere or a portion thereof, the number N being determined by the phased array antenna performance requirements for specific applications. One of the embodiments of the invention, the geodesic sphere structure 20, shown in FIG. 1 as part of a sphere, is constructed based on the icosahedron, one of the five regular polyhedra (Platonic solids) with twenty equilateral triangular sides. The geodesic sphere phased array antenna structure 20 is designed to provide greater than hemispherical coverage and in the present invention, the elevation angle of the structure extends from +90° through −θ° where θ° could be 45° to 30°. In some applications such as space based radars, the antenna structure of the invention for performing omni-directional radar and communication functions as an artificial satellite could be a full geodesic spherical structure. FIG. 1 also includes an exploded view of a subarray 22 containing antenna element clusters capable of two-way communication with dual frequency and dual orthogonal circular polarization capabilities.

Figure 2A:
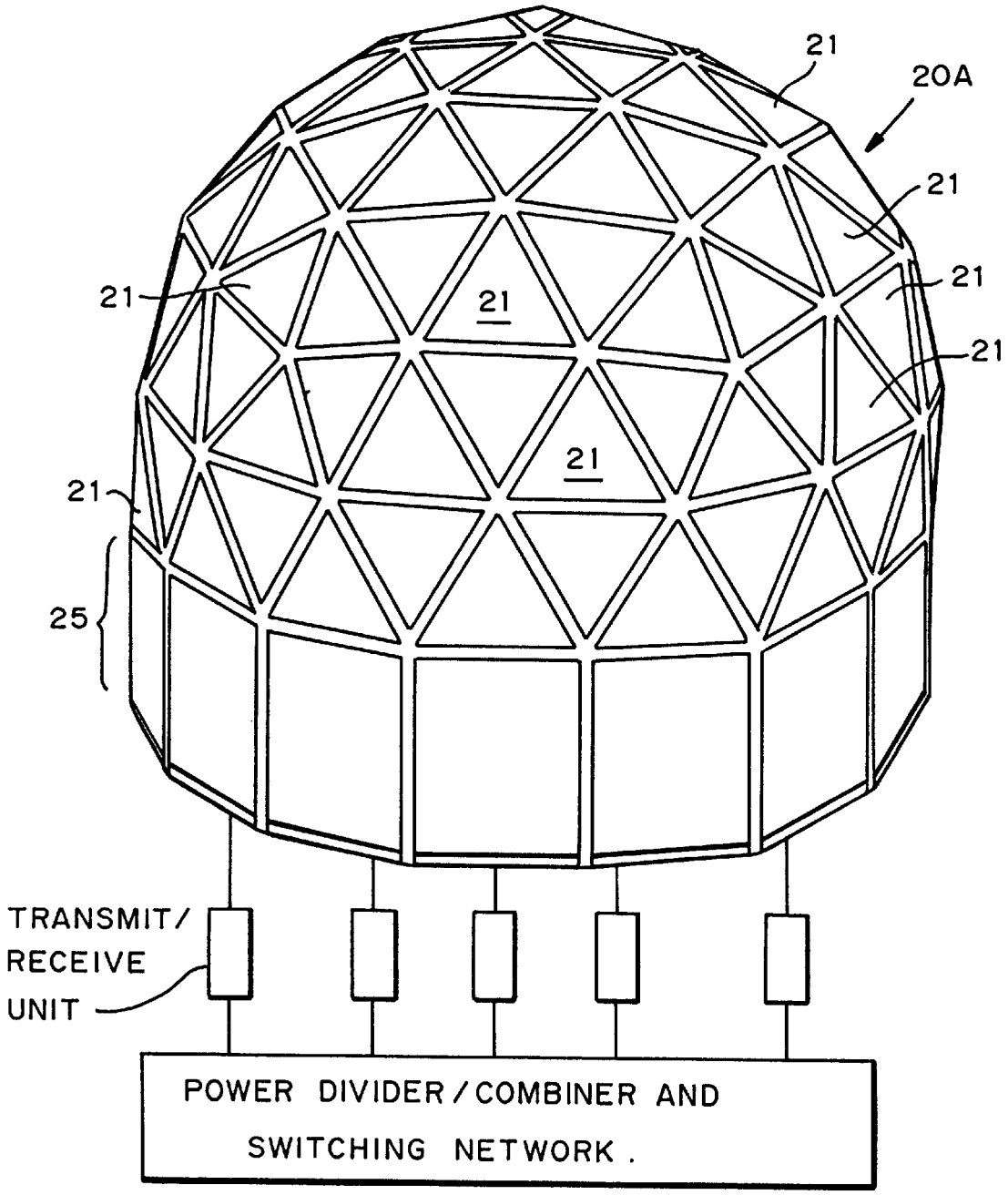
FIG. 2(*a*) is a schematic perspective view of one embodiment of the invention showing an array antenna system mounted on a a geodesic structure larger than a hemisphere and with electrical feed structure and signal processing means coupled to the antenna system.
Figure 2B:
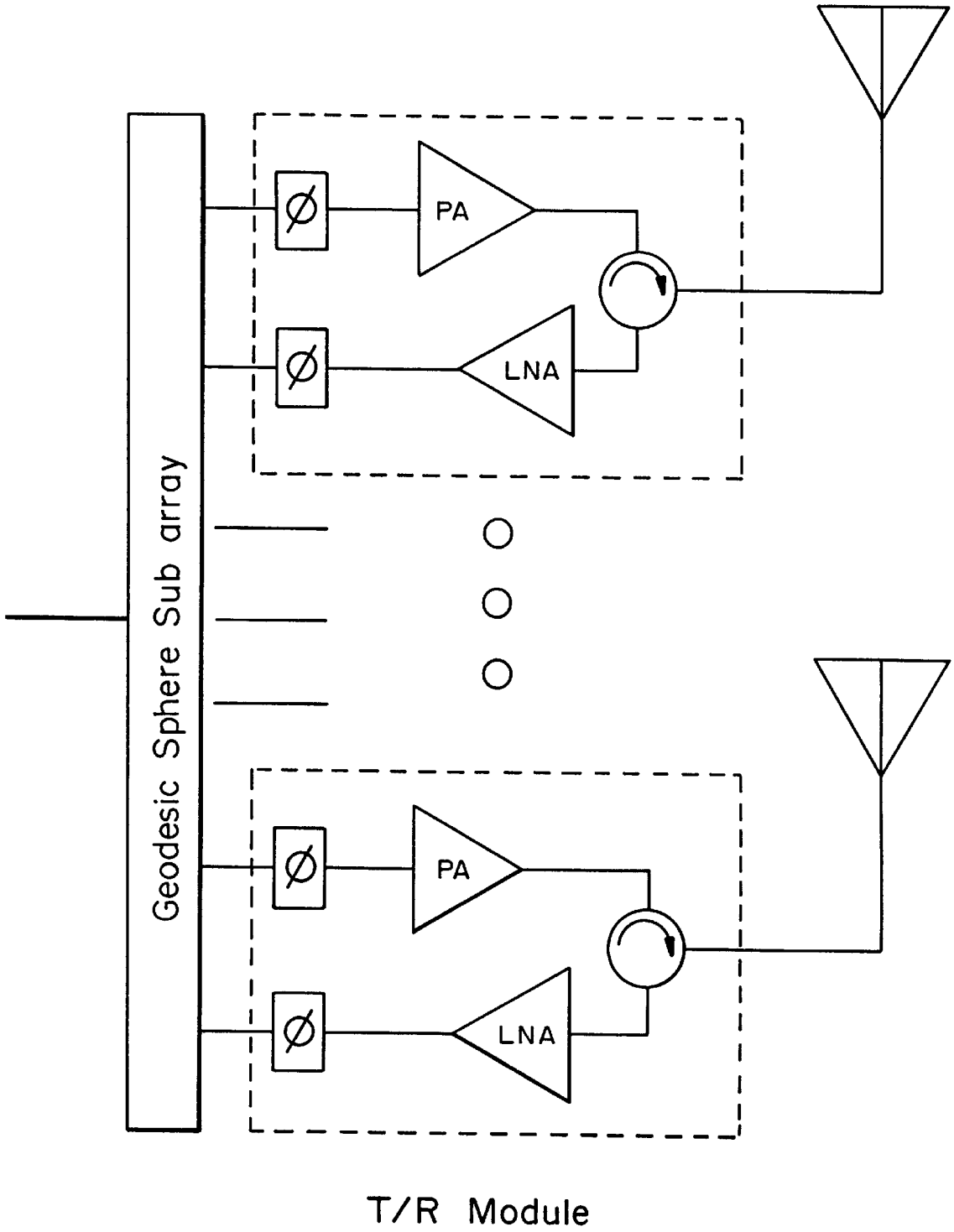

FIG. 2 shows a three dimensional schematic of the present invention, comprising a geodesic sphere phased array antenna 20A with power distribution and signal processing means. Each substantially equilateral triangular subarray building block contains array element clusters for simultaneous transmit and receive functions in an earth based station.

The geodesic structure of the antenna 20A, which is less than a full sphere but greater than a sphere, is mounted atop a platform 25 of any suitable construction. The Transmit/receive units 26 are connected by conductors 27 to each of the antenna clusters.

Figures 3A, 3B:
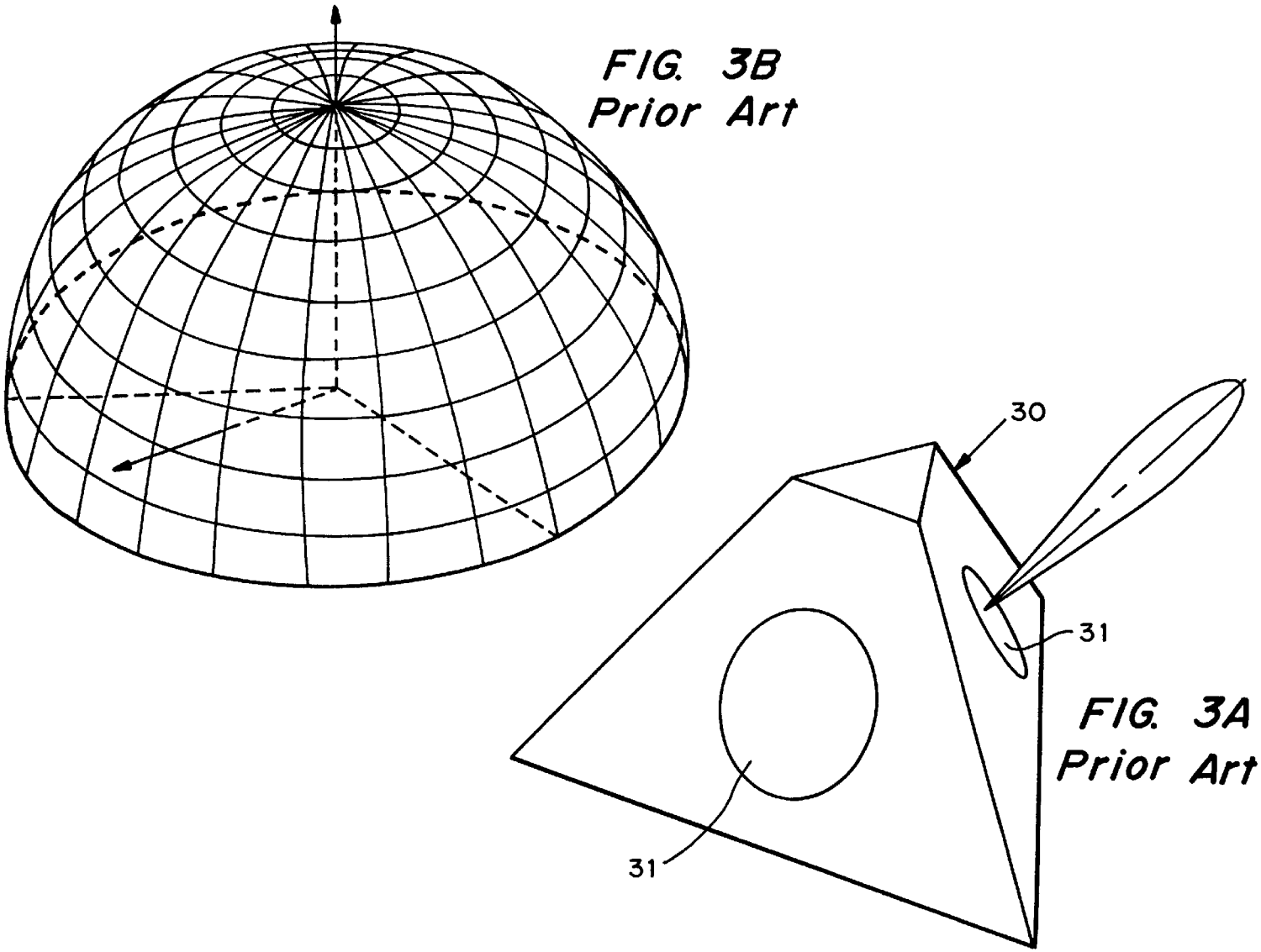
FIG. 3A Prior Art
FIG. 3B Prior Art
FIG. 3(*a*) is a schematic perspective view of a prior art antenna system comprising three planar phased arrays of antenna elements mounted on the three faces of a triangular pyramid and which provides communication coverage over an entire hemisphere.
Figure 4A:
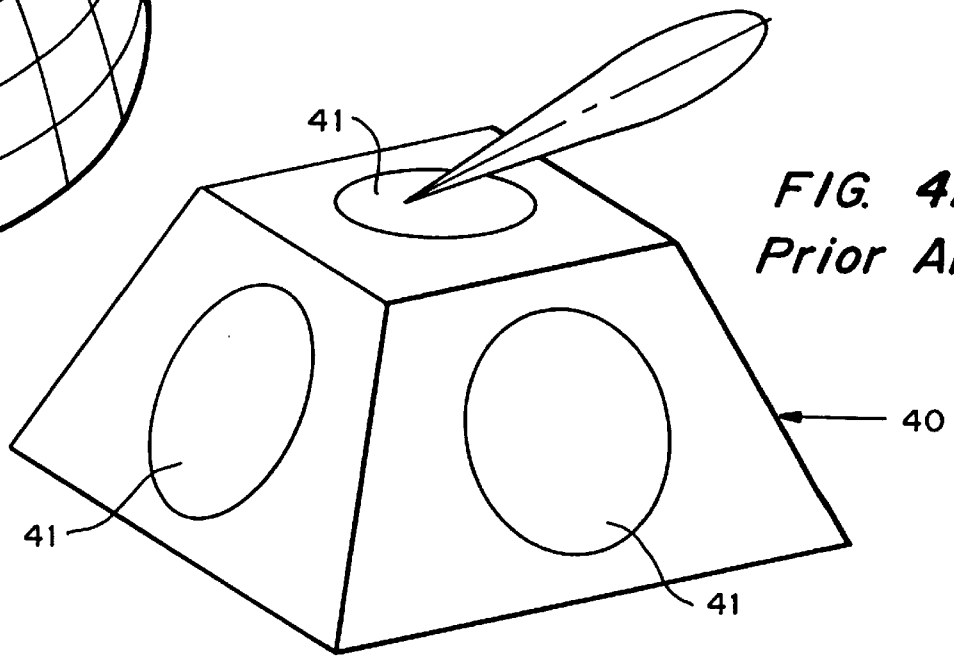
FIG. 4A Prior Art
FIG. 4(*a*) is a schematic perspective view of a prior art antenna system comprising five planar phased arrays of antenna elements mounted on the five faces of a frustum of a rectangular pyramid and which provides communication coverage over an entire hemisphere.
Figure 4B:
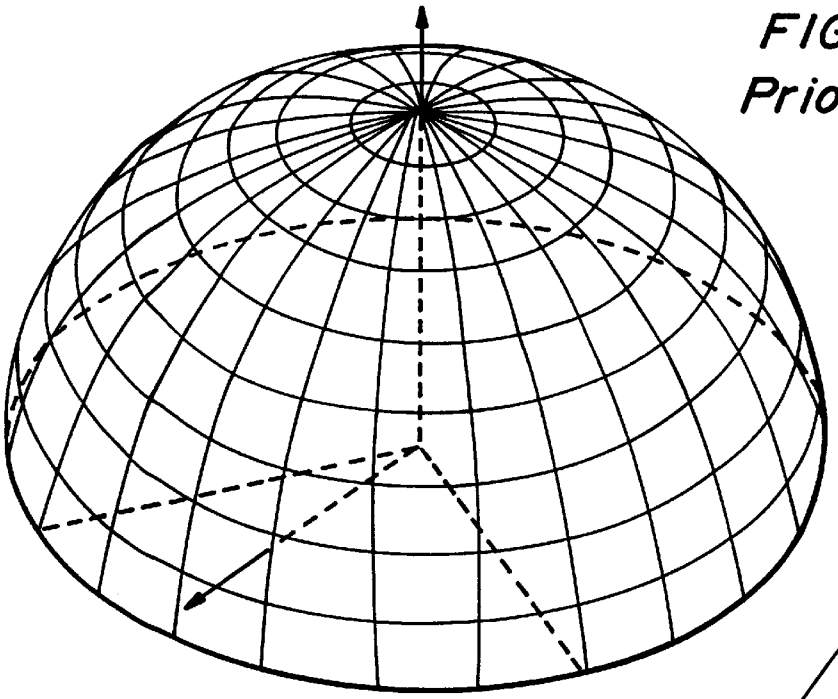
FIG. 4B Prior Art

Multi-planar phased array antenna structures of the prior art are shown in FIG. 3*a* and FIG. 3*b*. Three planar phased arrays 31 mounted on the three sides of a pyramid 30 for scanning the entire hemispherical communication space are shown in FIG. 3*a* and portions of the hemispherical communication space scanned by each of the three planar phased arrays are shown in FIG. 3*b*. Also in the prior art, five planar phased array structures 41 on the five faces of a frustum of a four sided pyramid 40 and scanning the entire hemispherical communication space are shown in FIG. 4*a*. The corresponding portions of the hemispherical communication space scanned by each of the five planar arrays are shown in FIG. 4*b*.

Figure 5A:
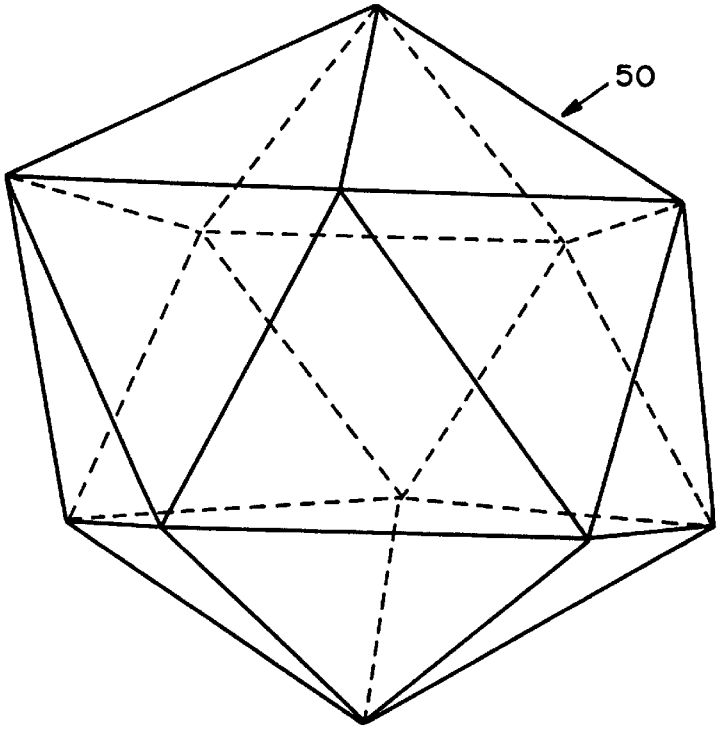
FIG. 5(*a*) is a perspective view of an icosahedron having twenty equilateral triangular faces.
Figure 5B:
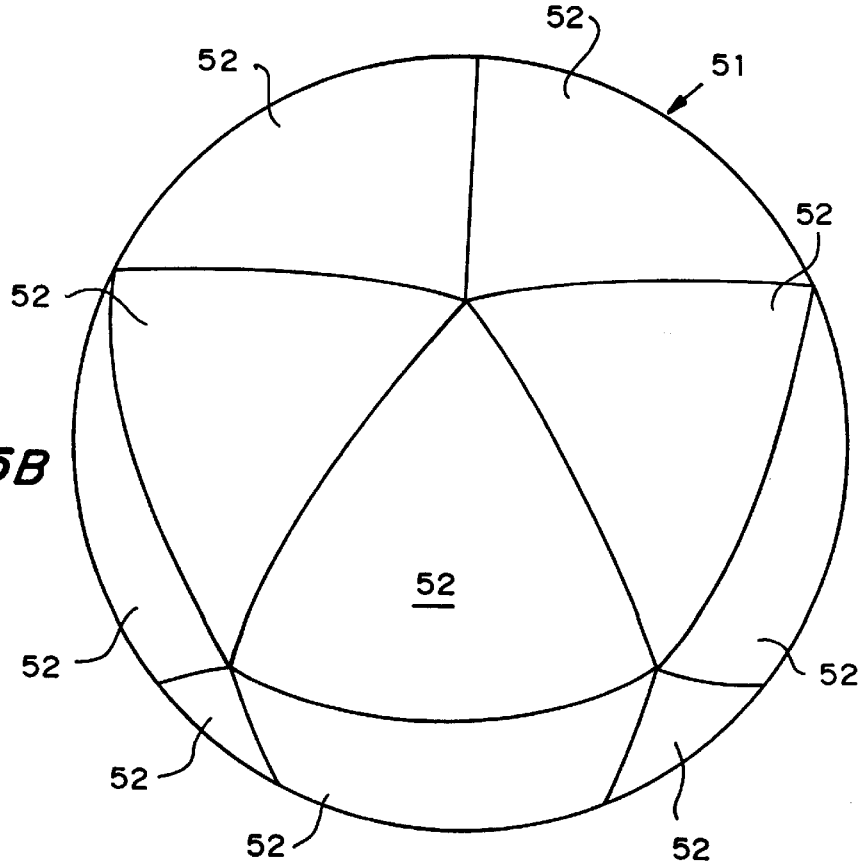

In one of the preferred embodiments, the icosahedron 50 shown in FIG. 5*a*, is the basis for the geodesic spherical antenna structure. FIG. 5*b* shows the circumscribing of the icosahedron by a sphere 51 which is divided into twenty equal triangular surfaces 52.

Figure 6A:
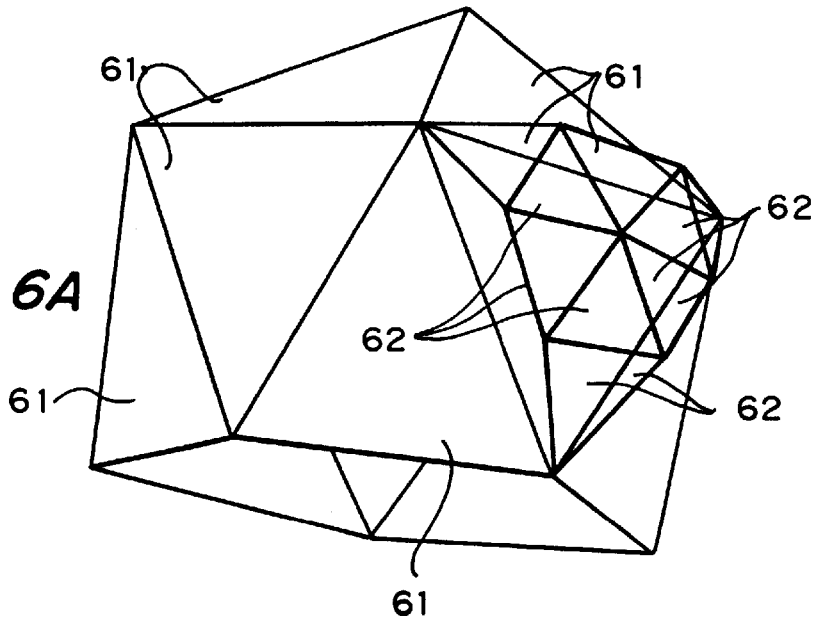
FIG. 6(*a*) illustrates a prodedural step in the formation of a geodesic sphere from the icosahedron of FIG. 5(*a*) wherein an equilateral triangular side of the icosahedron is divided into a plurality of triangular faces.
Figure 6B:
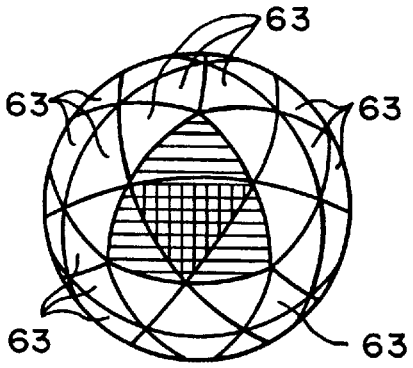
Figure 6C:
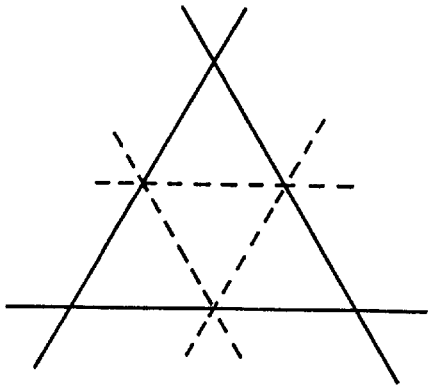

Construction of the geodesic sphere based on the full icosahedron is outlined in FIGS. 6(*a*), 6(*b*) and 6(*c*), which illustrates the procedural steps of construction. The geodesic sphere structure is created by dividing each of the equilateral triangular sides 61 of the inscribed icosahedron with a frequency of ν as shown in FIG. 6(*a*) and FIG. 6(*b*) where ν=3 in FIG. 6(*a*) and ν=2 in FIG. 6(*b*).

Corresponding dividing points are joined by straight lines to form $F_{84}$ number ubstantiallyequilateral triangular faces 62 where $$F_\nu = \sum_{n=1}^{\nu} (2n-1)$$

The vertices of the subdivided triangles are then pushed radially outwards and transposed to the circumscribing sphere thereby forming the vertices of the geodesic sphere. N number of substantially equilateral triangular subarray panels 63 are thus created for forming the geodesic sphere. A planar triangular side is formed by joining one vertex to two adjacent vertices with a planar surface. The construction process of the geodesic sphere is further outlined in the following three references:

[1]. Z. S. Makowski, Editor, Analysis, Design and Construction of Braced Domes, Nichols Publishing Company, New York, 1984, ISBN 0-89397-191-X;

[2]. Hugh Kenner, Geodesic Math and how to use it, University of California Press, Berkeley and Los Angeles, 1976, ISBN 0-520-02924-0; and

[3]. J. H. Lauchner, R. Buckminster Fuller, J. D. Clinton et.al., "Structural Design Concepts for Future Space Missions", NASA Contract NGR 14-008-002, Progress Report, Accession Number N69-29417, 1968.

Corresponding to this division, known as the alternative breakdown with frequency ν, the following number of vertices(V), edges(E), and faces(F) are obtained for the full geodesic sphere as shown in Table 1 below and which are generated from the relations derived in equations (1), (2), (3).

$$V_{Geodesic\ Sphere}[\upsilon] = V_{icosahedron} + F_{icosahedron}\cdot\left(\sum_{n=1}^{\upsilon-2} n\right) + (\upsilon-1)\cdot E_{icosahedron} \quad (1)$$

$$E_{Geodesic\ Sphere}[\upsilon] = \upsilon\cdot E_{icosahedron} + F_{icosahedron}\cdot\left(3\sum_{n=1}^{\upsilon-1} n\right) \quad (2)$$

$$F_{Geodesic\ Sphere}[\upsilon] = F_{icosahedron}\cdot\left(\sum_{n=1}^{\upsilon}[2n-1]\right) \quad (3)$$

The results in Table-1 are derived from these equations.

TABLE 1

Quantitative description of the geodesic sphere

| | (for the full geodesic sphere) | | | (for 3/4th geodesic sphere) |
|---|---|---|---|---|
| frequency ν | number of vertices | number of edges | number of faces | number of faces |
| 1 (icosahedron) | 12 | 30 | 20 | 15 |
| 2 | 42 | 120 | 80 | 60 |
| 3 | 92 | 270 | 180 | 135 |
| 4 | 162 | 480 | 320 | 240 |
| 5 | 252 | 750 | 500 | 375 |
| 6 | 362 | 1080 | 720 | 540 |
| 7 | 492 | 1470 | 980 | 735 |
| 8 | 642 | 1920 | 1280 | 960 |
| 9 | 812 | 2430 | 1620 | 1215 |
| 10 | 1002 | 3000 | 2000 | 1500 |

Each of the planar triangular sides is equipped with a planar subarray of phased antenna element units with associated feeding structure, beam forming network and signal processing means making the subarray, in conjunction with other adjacent subarrays, capable of simultaneous tracking of multiple satellites and transmitting and receiving multiband electromagnetic signals in the microwave and millimeter wave frequency ranges.

The geodesic sphere phased array antenna to be constructed for hemispherical coverage will be larger than the hemisphere but less than a full sphere. Depending on the array antenna gain required for specific applications, the geodesic sphere array structure may extend in elevation space from −45° through +90° (zenith) which is ¾th sphere.

The operation of the geodesic sphere phased array antenna will now be explained with the help of reference to FIG. 7 and FIG. 8. Central to the present invention and the most important aspect of the geodesic sphere array operation is the fact that the entire communication space, which could be the entire sky for tracking and communication with artificial satellites, is subdividable into a large number of small cells. Corresponding to each such small cellular communication space, an array of contiguous planar triangular subarrays are energized and phased to set up a beam within that particular communication space and provide electronic scanning capability within that cellular communication space. The size of the array consisting of the planar triangular subarrays is determined by the antenna gain and beam width requirements which are specified by the needs of establishing robust communication links between the communication satellite and the earth station. The size of each cellular communication space is determined by the phased array antenna system operation requirements and the specific design considerations. For communications within another cellular space, another array consisting of another set of contiguous planar triangular subarrays corresponding to the direction of the cellular space, is formed. This new array is energized and phased to project a beam in this particular cellular communication space and electronically scan this particular cellular region. Thus, each subarray is required to limit electronic scanning within a small angular region defined by the extent of the cellular space. This provision allows for better and efficient array design, measured in terms of better antenna element impedance matching and avoidance of grating lobes.

Figure 7:
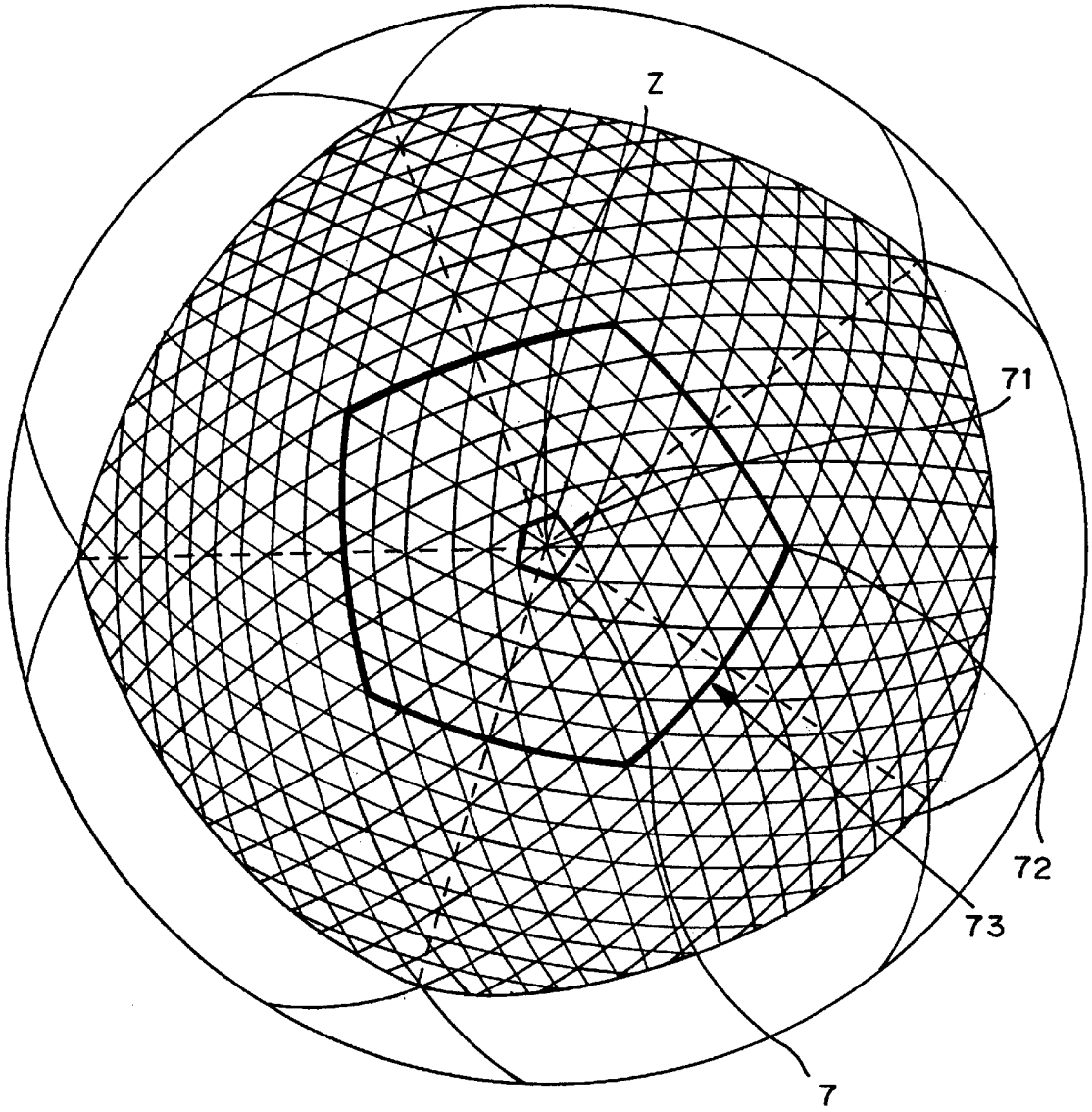
FIG. 7 is a view of the geodesic sphere created from the icosahedron of FIG. 5(*a*) and showing the energized portion of the geodesic sphere array of a plurality of contiguous subarrays that forms an electromagnetic beam along its broadside (zenith) direction towards a vertex of the geodesic sphere.

FIG. 7 shows the top view of a portion of the geodesic sphere phased array of the invention. For illustration purposes, the central hereby outlined portion 71 bounded by adjacent vertices 72 of the geodesic sphere centered is around a vertex (z) defines a cellular region of the communication space. This cellular region is to be electronically scanned by a beam formed by the array of M contiguous planar triangular subarrays defined by the larger outlined pentagon portion 73 of the array. The number of energized planar triangular subarrays M is determined by the antenna gain required for the specific communication application. It must be mentioned that based on the specific communication needs, instead of a whole planar triangular subarray, a portion of the subarray may be energized. Electronic phase shifters coupled to the antenna element units of the energized portion of the array will provide electronic beam scanning capability within the cellular communication space defined earlier. For this specific description, the size of the cellular communication space is estimated by the angular distance between two adjacent vertices. If $\nu$ is the frequency of the alternative breakdown scheme of constructing the icosahedron based geodesic sphere, then the angular distance between two adjacent vertices of the geodesic sphere is $\theta=60.575°/\nu$.

Structural symmetry is a very important aspect of the geodesic sphere phased array antenna operation and must be taken into account very carefully. Array symmetry plays an important role in maintaining good polarization and radiation pattern characteristics in the scanned array operation. For the symmetry reasons, the energized portion of the array is chosen so as to set up the main beam in the direction of a geodesic vertex and this array is phased to electronically scan the cellular communication space defined by the adjacent vertices.

Figure 8:
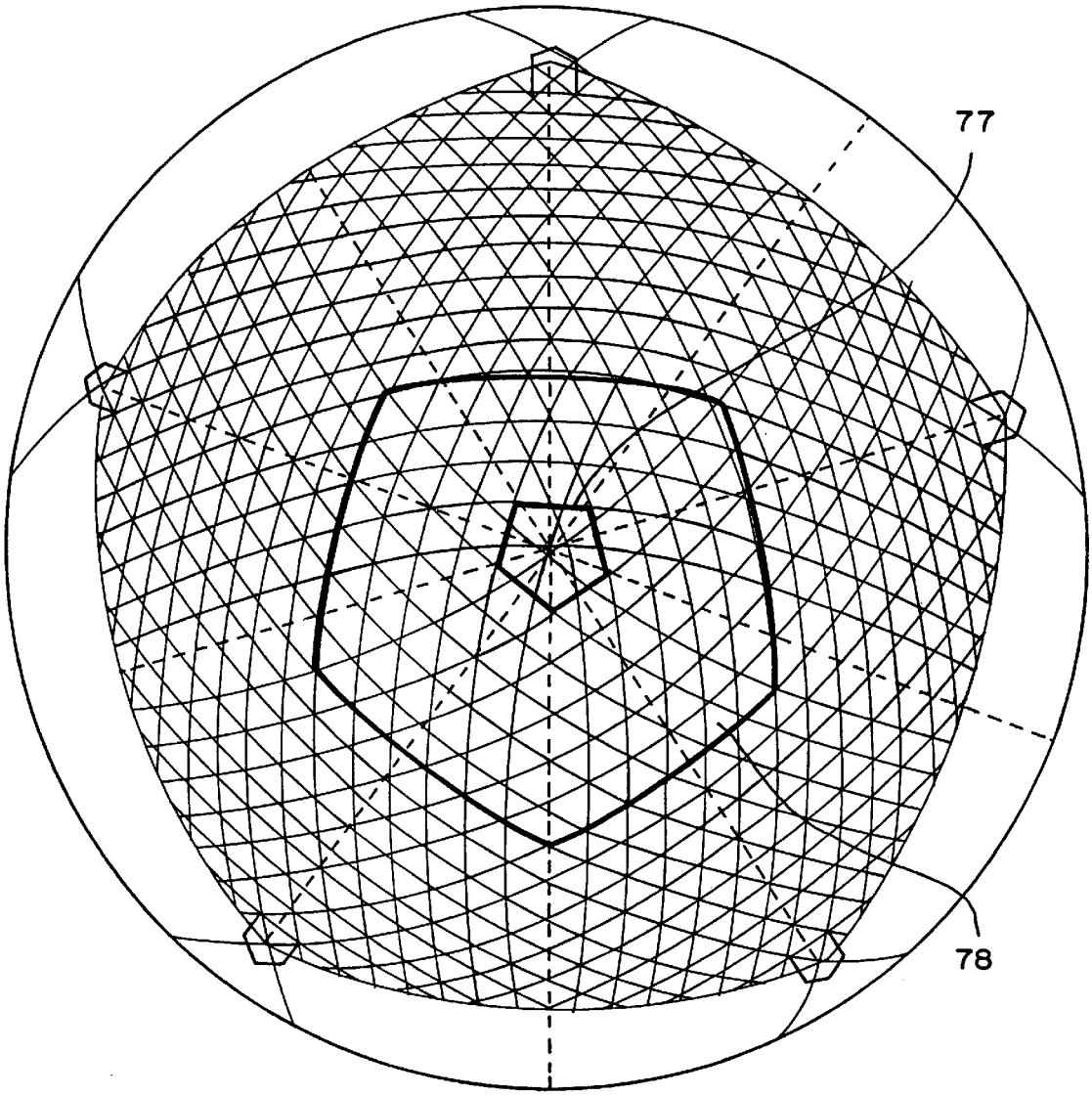
FIG. 8 is a view similar to FIG. 7 but showing an energized portion of the geodesic sphere array wherein another set of a plurality of contiguous subarrays that forms an electromagnetic beam along its broadside direction which may correspond to another vertex of the geodesic sphere, which is adjacent to the vertex along which the electromagnetic beam is generated in FIG. 7.
Figure 9B:
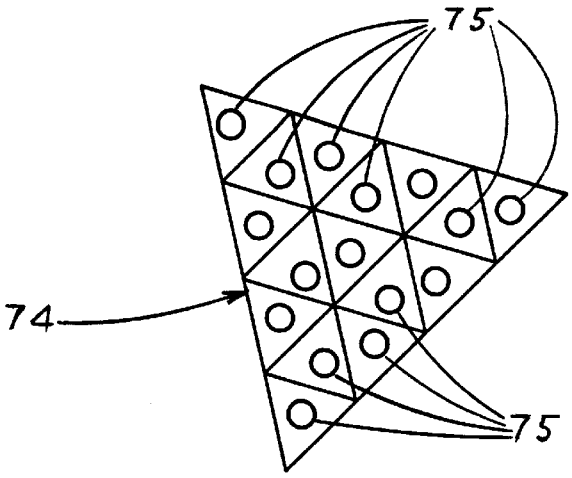
FIG. 9(*a*) is a perspective view of a portion of the geodesic spherical structure created from one of the twenty faces of the regular icosahedron by means of alternative breakdown scheme with frequency $\nu=4$, containing 16 substantially equilateral triangular planar subarray panels.
Figure 9A:
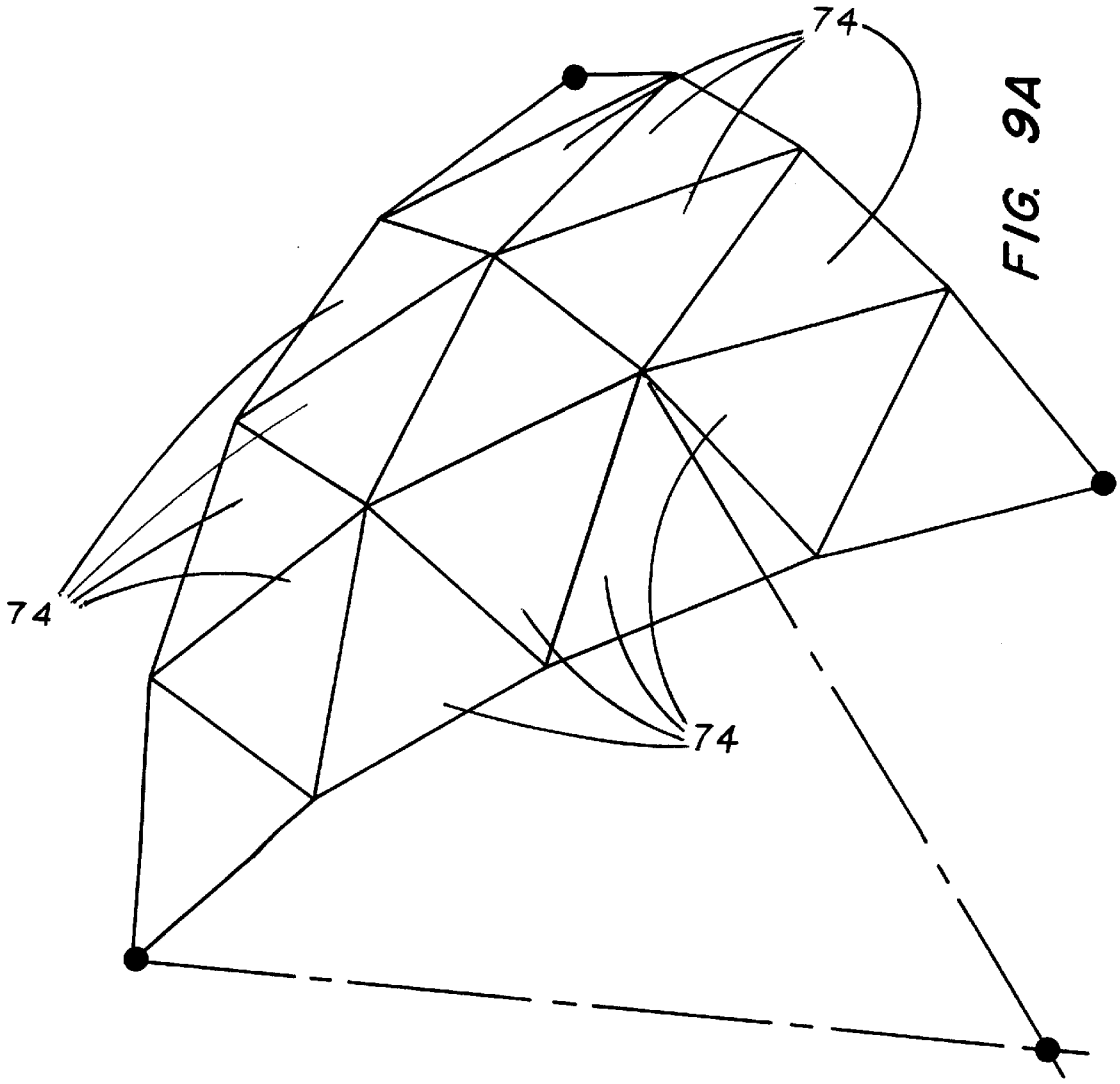

FIG. 8 shows another energized portion of the geodesic sphere array wherein the smaller outlined pentagon region 77 defines another cellular communication space and the larger outlined pentagon portion 78 defines the new energized portion of the array for electronically scanning this cellular communication space. The array operation is controlled by a computer and the subarray switching and beam steering units are designed such that tracking and communication operations are conducted smoothly across the cellular communication subspace. When the antenna beam has to move into a new cell, a small portion of the subarrays are deenergized and disconnected and another new small portion of the subarrays are energized and connected to maintain the same beam shape and characteristics. The array is to be so designed that this rapid transition will have no effect what-so-ever in continuing the tracking and communication functions. Although in forming a beam, one subarray is considered as a unit to be added or subtracted from the energized portion of the array, it could generally be the case that instead an antenna element cluster be considered as the basic unit in forming the energized portion of the array.

Each antenna element unit is provided with electronic switching means, to be connected to or be disconnected from the active portion of the feed network of the array at any given time. When connected, the antenna element unit switching connection is designed to provide good impedance matching within the active feed network so that the optimum signal power transfer can take place. Whereas when the antenna element unit is to remain disconnected, it is terminated with a matching impedance so that residual reflections from the is inactive units contribute minimum disturbance to the active portion of the array.

The antenna element unit mentioned here could be the triangular subarray itself constituting the geodesic sphere or it could be each of the cluster elements constituting the triangular subarray. Alternatively, it could be each of the basic radiating elements of the triangular subarray.

Referring to FIG. 7, M number of subarrays are energized to produce the main beam for transmission or reception pointed towards the direction corresponding to a vertex of the geodesic sphere. The radius of the geodesic sphere as well as the number of subarrays M is determined by the width of the main beam and the center frequency of operation.

For producing the main beam in another direction corresponding to another vertex of the geodesic sphere, a new set of M subarrays corresponding to that direction will be energized. In the intermediate communication space amongst the adjacent vertices this array of M subarrays need only scan. This results in a very limited scanning requirement for the array of M subarrays.

The most important aspect of this invention is the cellular scanning idea wherein the energized portion of the phased array, consisting of the appropriate number of contiguous subarrays that sets up an electromagnetic beam in a given direction, changes with the direction of the beam. The key point of the invention is to limit the electronic scanning requirement for any of these beams to a cellular communication space which in a preferred configuration, could be bounded and defined by the adjacent vertices of the geodesic sphere. The geodesic sphere phased array antenna may be so constructed that this scanning requirement is less than 10° off broadside within a conical scanning space.

In this preferred embodiment, each element unit of the subarray is phased to electronically scan only the small cellular region whereas, each subarray as a whole, if energized, need only be phased to point at fixed directions corresponding to the vertices of the geodesic sphere which are the central directions of the cellular communication spaces.

One important but undesirable feature of phased array antennas is that when the phased array is scanned, depending on the inter-element spacings, an undesired beam, called the grating lobe, may be formed in a certain undesired direction and whose amplitude may be comparable to that of the desired main beam. Avoidance of grating lobe formation places a restriction on the interelement spacings in the array. Analytical calculations have shown that for arrays on spherical surfaces, larger inter-element spacings can be permissible, compared to a planar array before grating lobes are formed in the visible space for the same scanning capability. It has been found from numerical analysis and computations of spherical phased arrays that for wider spacings and larger scan angles, the amplitudes of the grating lobes, if formed, are substantially lower than that of the main lobe.

Each of the substantially equilateral triangular subarray panels will consist of L number of antenna elements where $$L=\sum_{n=1}^{\nu}(2n-1)$$

where $\nu'$ is the frequency of the preferred subarray partition scheme similar to the alternative breakdown scheme in the geodesic sphere construction. Each of the antenna element units could be a single element or a cluster of 2×2 basic elements. Each of the antenna element units are constructed to be capable of generating and receiving dual orthogonal circular polarizations at dual frequency bands corresponding to the simultaneous transmit and receive operational needs of satellite communication earth stations.

Figures 10A, 10B:
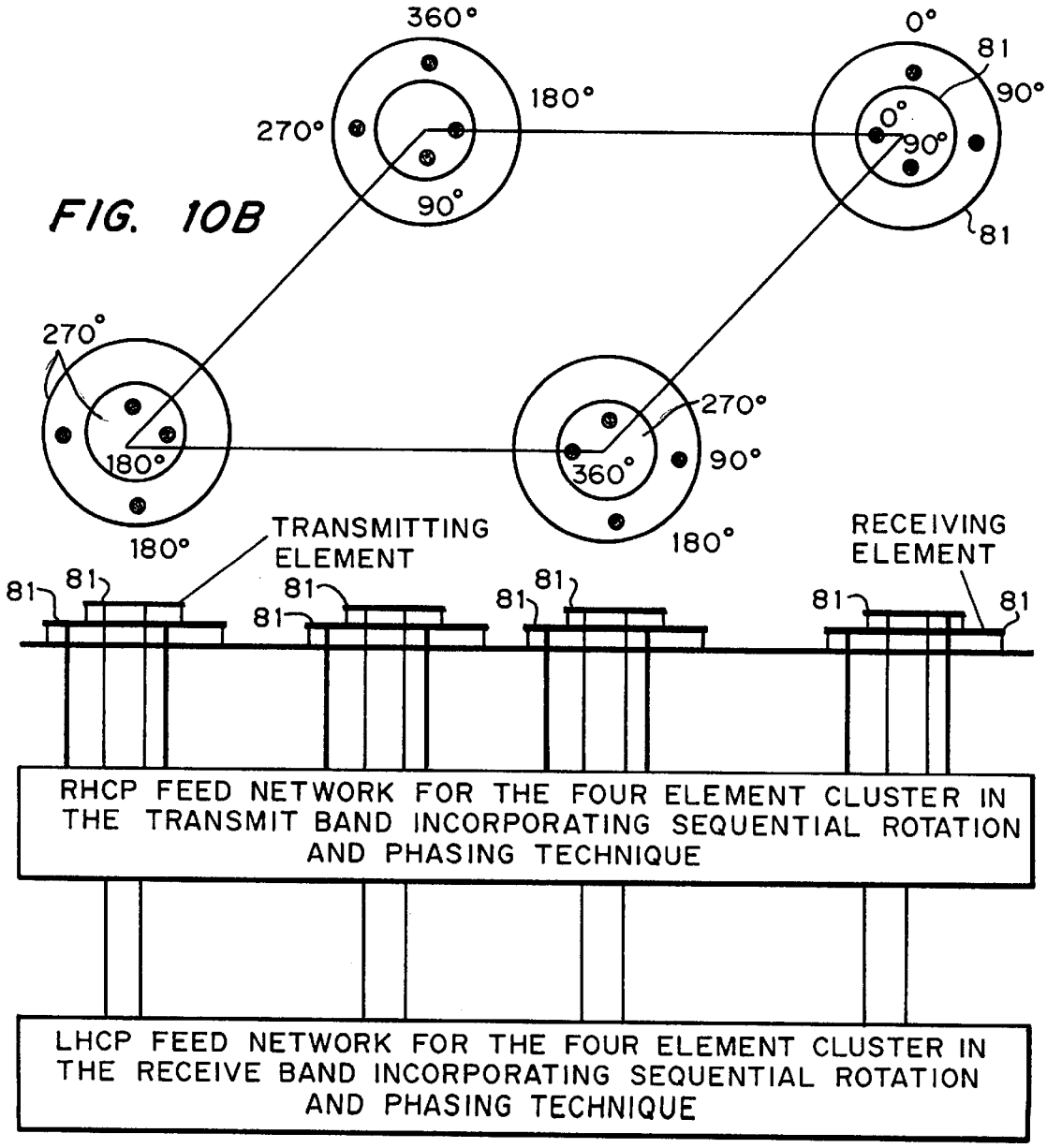
FIG. 10(*a*) is a schematic plan view of the feed network for the four element dual-band dual-circular polarized cluster of antenna elements as provided on each of the triangular faces of the geodesic sphere antenna subarray in FIG. 9(*b*)

FIG. 10(*a*) and FIG. 10(*b*) show one embodiment of a 2×2 element cluster capable of simultaneously transmitting right circular polarization in one frequency band and receiving left circular polarzed signal at another frequency band. In this arrangement, each antenna element is provided with dual feed to excite the specific sense of circular polarization. Sequential rotation and phasing techniques are implemented on the 2×2 cluster with the feed structure to enhance the specific sense of circular polarization capabilities of the 2×2 cluster. These method of construction and excitation of the element cluster increases the impedance bandwidth and axial ratio bandwidths of the element cluster.

Figure 11A:
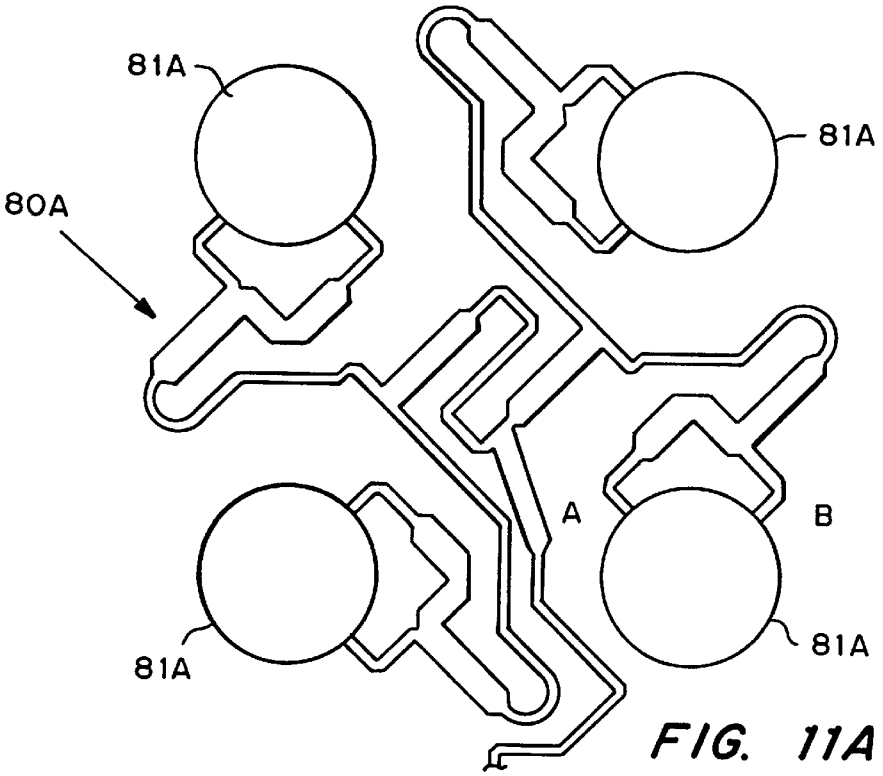
FIG. 11(*a*) is a schematic diagram of a four element microstrip antenna array with microstrip feed lines connected thereto whereby the antenna produces right circularly polarized radiation.
Figure 11B:
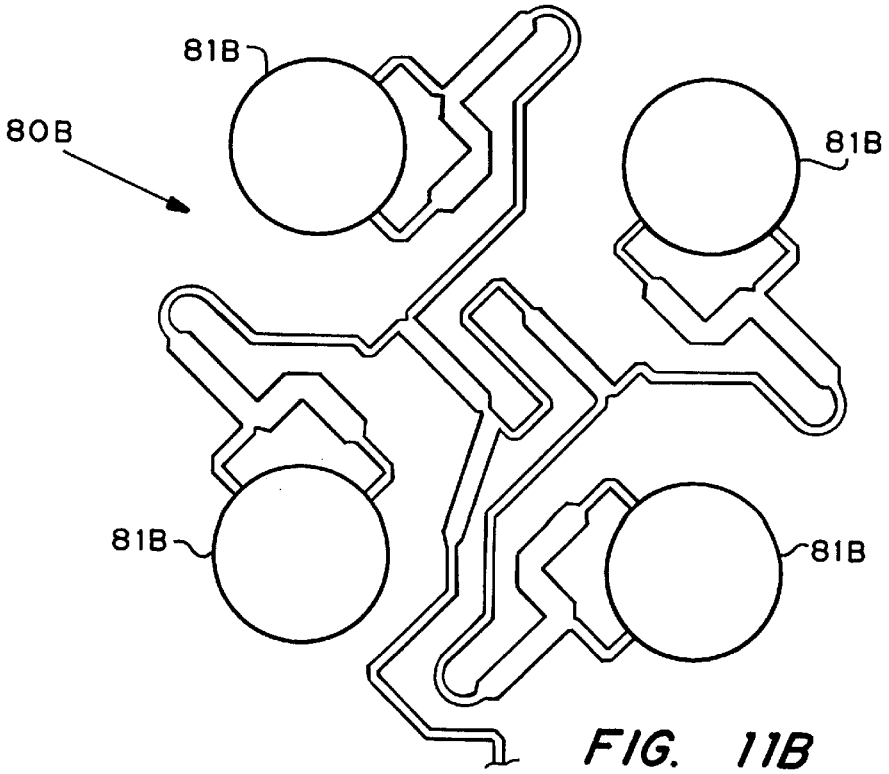

FIG. 11*a* shows a schematic diagram of a four element microstrip array 80 A of antenna elements which can be used as an array element unit in the present invention. Such an array element unit as described in U.S. Pat. No. 5,661,494 and U.S. Pat. No. 5,886,667 comprises four circular shaped antenna elements 8*a* A. Each radiating element 81A in the array is an electrically conducting microstrip metal sheet, and as a copper sheet, which is superimposed on a dielectric plate having a metallized backside which serves as the ground plane for the antenna. Each element 81A is adapted to be excited and circularly polarized by a dual feed microstrip feed line coupled thereto at points A and B for feeding the elements in simultaneous space and phase quadrature so as to excite the element in a circular polarization and the elements in the cluster excited in sequential rotation and phasing with respect to each of the other elements so that the antenna structure can function as a broad band antenna element unit with enhanced axial ratio and input impedance bandwidths. In FIG. 11*a* the antenna element cluster 80A is right circularly polarized for transmission whereas in FIG. 11*b* the antenna array 80B, comprised of antenna elements 81B, is designed for left circular polarization transmission.

The right frame of the geodesic sphere phased array antenna should be made of materials that produce the least amount of electromagnetic scattering. It could be preferably made of electrically insulating materials such as brick, stone, fiber glass, plastic, composite materials, ceramics or it could be a metallic structure with appropriate coatings of insulating and electromagnetic wave absorbing materials so as to minimize deleterious effects of scattering and diffraction on the array antenna performance.

Figure 13A:
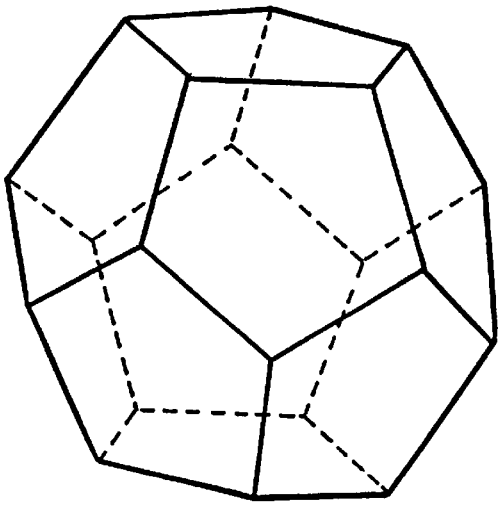
FIG. 13(*a*) is an illustration of a dodecahedron which can be used as a geodesic sphere structure for a phased array antenna in accordance with the present invention.
Figure 13B:
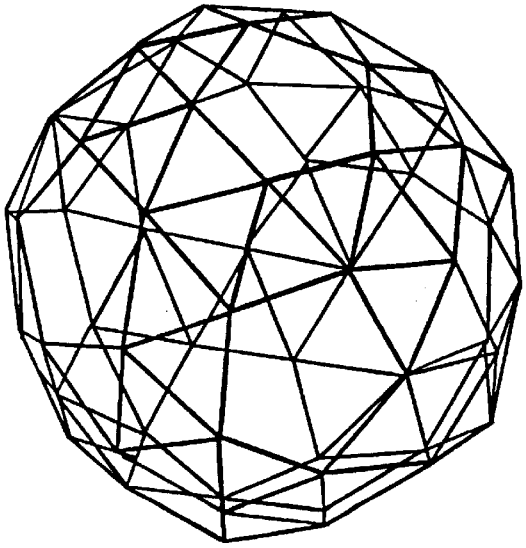
Figure 13C:
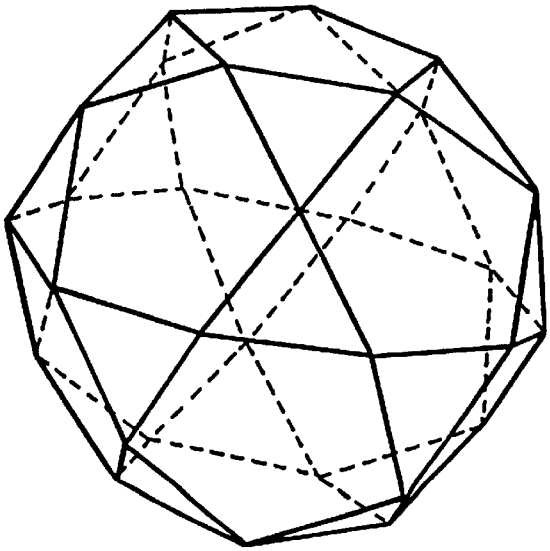

The preferred embodiment of the geodesic sphere antenna structure presented above is based on the icosahedron, one of the five regular polyhedra known as the Platonic solids. The icosahedron with twenty equilateral triangular sides as shown in FIG. 5*a*. There are four regular polyhedra—the tetrahedron, the cube, the octahedron, the dodecahedron and the icosahedron. The schematic of the dodecahedron is shown in FIG. 13*a*.

Figure 12A:
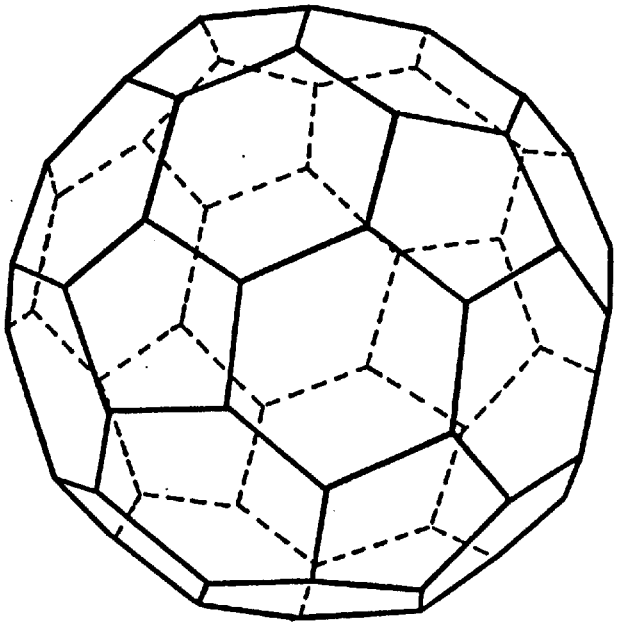
FIG. 12(*a*) is an illustration of a truncated icosahedron which can be used as a geodesic sphere structure, in another embodiment of the phased array antenna of the invention.

Another preferred embodiment of the geodesic sphere phased array antenna structure is based on the truncated icosahedron shown in FIG. 12*a*. The geodesic sphere based on the truncated icosahedron is popularly known as the Buckminster fullerene or 'Buckyball' in recognition of the geodesic structure proposed by R. Buckminster Fuller in his U.S. Pat. No. 2,682,235 (filed Dec. 12, 1951, issued Jun. 29, 1954).

The truncated icosahedron based geodesic sphere consists of 12 regular pentagons and 48 regular hexagons. Each of these regular pentagons and hexagons are further subdivided into equal triangular regions and the intersecting point in each of the pentagons and hexagons are pushed radially outwards and transposed to the surface of the circumscribing sphere thus creating the geodesic sphere structure for the array antenna shown in FIG. 12*b*.

Figure 12B:
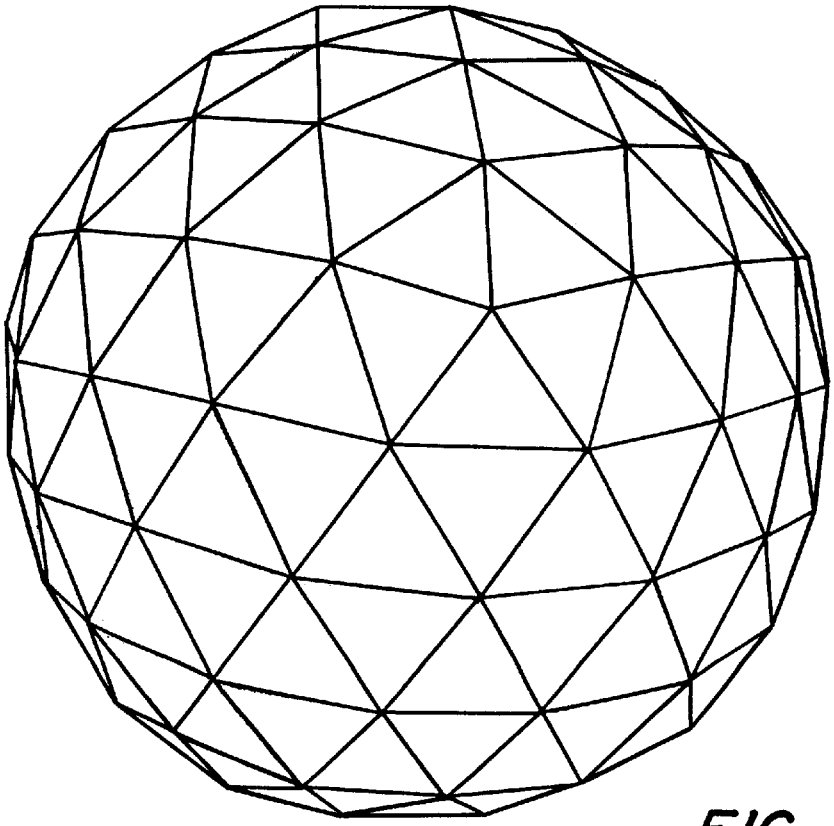

The geodesic sphere array antenna structure could also be constructed based on one of the fifteen semi-regular polyhedra (also known as the Archemedian solids). There are fifteen semi-regular polyhedra—that include the truncated tetrahedron, the truncated cube, the truncated octahedron, the truncated dodecahedron, the truncated icosahedron, the semi-regular prism, the rhombicuboctahedron, the semi-regular prismoid, the cuboctahedron, the icosidodecahedron, the snub-cube, the snub-dodecahedron, the rhombicosidodecahedron, the truncated cuboctahedron and the truncated icosidodecahedron. The schematics of the snub icosidodecahedron and the icosidodecahedron are shown in FIG. 12*b* and FIG. 12*c* respectively.

Another key point of the present invention is grouping of elements in each of these M subarrays of the geodesic sphere, as 2×2 clusters to which Transmit/Receive units are connected for communication signal processing. Relatively small angle electronic scanning requirement of the geodesi sphere array permitted by the cellular scanning method and apparatus described herein allows this grouping without causing grating lobes to appear in the entire communication space. At the present time, the cost of the T/R units amounts to approximately 40% of the total construction cost of the phased array antenna. Therefore, a low cost phased array antenna is realized by the fact that instead of attaching a T/R switch for each individual basic antenna elements when wide angle scanning is necessary, we need attach T/R units only to a 2×2 cluster leading to a substantial savings in the cost of manufacture and maintenance as only very limited scanning is necessary.

It is to be appreciated that the 2×2 element cluster is the preferred basic building block of the geodesic sphere phased array antenna in the present invention and is a dual band structure capable of transmitting dual orthogonal circular polarization in one frequency band and simultaneously receiving dual orthogonal circular polarization in another frequency band.

For the icosahedron based geodesic sphere with the frequency of alternative breakdown of each faces =ν, the angular separation between adjacent vertices equals 60.57520 /ν. This angular separation which is also dependent on the structural construction considerations, tracking accuracy, frequency of operation and other mechanical and electrical considerations can vary thus allowing higher order grouping of the basic antenna elements such as a 4×4 cluster or even a 16×16 cluster. Therefore the 2×2 cluster emphasized here is not the only arrangement but rather a preferred arrangement. Further, ν, the frequency of alternative breakdown of each of the faces of the inscribing icosahedron, is dependent on structural considerations as well as important electrical performance requirements such as the beam width and tracking accuracy. Therefore, the total number of subarray panels in the geodesic sphere and the number of element clusters in each of the panels will vary with the particular design and performance requirements and can be be readily determined by those skilled in the antenna alt.

The geodesic spheres described here are based on the icosahedron, a regular polyhedra or a Platonic Solid and the truncated icosahedron, a semiregular or Archemedian solid. It could also be based on one of the other four Platonic solids or one of the fourteen other semiregular polyhedra or Archemedean solids.

It is to be appreciated therefore that various material and structural changes may be made by those skilled in the art without departing from the spirit of the invention.

Therefore, I claim:

1. A geodesic sphere phased array antenna system for multi-satellite communications and tracking, said antenna system comprising:

a geodesic structure derived from an icosahedron having a plurality of planar equilateral triangular faces, each of which is subdivided into multiple smaller planar triangular surface regions and each of the vertices of said multiple triangular planar regions projected outward on to the circumscribing spherical surface defining said geodesic structure with a plurality of substantially equilateral triangular geodesic planar surfaces; a subarray of planar antenna element units mounted on each of said plurality of substantially equilateral triangular geodesic planar surfaces;

transmit and receive signal processing means connected to each said planar antenna element unit of each said triangular subarray for simultaneous transmission and reception of signals; electromagnetic signal feed means connected to each said planar antenna element unit of each said subarray for forming at least one electromagnetic beam in space;

electronic switching means for selectively connecting each said subarray to adjacent subarrays for generating multiple electromagnetic beams in selective diverse directions in space;

electronic phase shifting means connected to each said planar antenna element unit of each said subarray for providing electronic scanning capability to said subarrays of antenna element units connected by said electronic switching means with the phased array communication space being segmented into a plurality of smaller cellular space, each said cellular communication space for electronic scanning being defined by a plurality of discrete chosen directions, corresponding to the said geodesic sphere phased array structure and each said cellular communication space adapted to be electronically scanned by a plurality of active said contiguous phased subarrays corresponding to the said cellular communication space.

2. The geodesic sphere phased array antenna as set forth in claim 1 wherein said geodesic structure is derived from alternative subdivision of the equilateral triangular faces of the icosahedron.

3. The geodesic sphere phased array antenna as set forth in claim 1 wherein said geodesic structure is derived from triacon subdivision of the equilateral triangular faces of the icosahedron.

4. The geodesic sphere phased array antenna as set forth in claim 1 where the antenna element in each of the geodesic planar triangular surfaces is a multi-band element operating in the ultra high frequency through microwave and millimeter wave regions of the electromagnetic spectrum.

5. The geodesic sphere phased array antenna as set forth in claim 1 where the antenna element in each of the geodesic planar triangular surfaces is a dual-band, dual-circular polarized element capable of simultaneously transmitting with one sense of circular polarization in one frequency band and receiving signals of the orthogonal sense of circular polarization in another frequency band.

6. The geodesic sphere phased array antenna as set forth in claim 1 where the antenna element in each of the geodesic planar triangular subarray panels is a 2×2 cluster array of dual-band, dual-circular polarized basic elements capable of simultaneously transmitting signals with one sense of circular polarization in one frequency band and receiving signals of the orthogonal sense of circular polarization in another frequency band.

7. The geodesic sphere phased array antenna as set forth in claim 6 where the transmission and receiving capabilities of the antenna elements in each of the geodesic planar triangular subarray panels are in the same frequency band used in performing radar functions.

8. The geodesic sphere phased array antenna as set forth in claim 6 where each of the said 2×2 element clusters in each of the said subarrays is provided with phase shifting means to provide electronic scanning capability to the plurality of said contiguous subarrays.

9. The geodesic sphere phased array antenna structure in claim 1 where the feed structure connecting the 2×2 cluster of antenna elements employ simultaneous sequential rotation and phasing technique to enhance axial ratio bandwidth and the impedance bandwidth of the circular polarized signals.

10. The geodesic sphere phased array antenna as set forth in claim 1 where each of the triangular subarray of antenna elements is provided with individual phase shifting means for electronic scanning by a plurality of said contiguous subarrays.

11. The geodesic sphere phased array antenna as set forth in claim 1 where each of the said chosen directions for each said cellular communication space segments corresponds to the direction of a vertex from the center of said geodesic sphere.

12. The geodesic sphere phased array antenna structure of claim 11 where each of the said cellular communication space segments around the direction of a vertex of the said geodesic sphere is defined by the adjacent vertices of the said geodesic sphere.

13. The geodesic sphere phased array antenna structure as set forth in claim 1 where the said structure is a full geodesic sphere and is deployable as a space based radar and communication satellite.

14. A geodesic sphere phased array antenna system for multi-satellite communications and tracking, said antenna system comprising:

a geodesic structure derived from a truncated icosahedron having twelve pentagonal and twenty hexagonal planar faces, a plurality of said geodesic planar surfaces each having mounted thereon a subarray of planar antenna element units;

transmit and receive signal processing means connected to each said planar antenna element unit of each said subarray for simultaneous transmission and reception of signals;

electromagnetic signal feed means connected to each said planar antenna element unit of each said subarray for forming at least one electromagnetic beam in space;

electronic switching means for selectively connecting each said planar antenna element unit of said subarrays to adjacent planar antenna element unit of said subarray or adjacent subarrays for generating multiple electromagnetic beams in selective diverse directions in space;

electronic phase shifting means connected to each said planar antenna element of each said subarray for providing electronic scanning capability to said subarrays of antenna element units connected by said electronic switching means with the phased array communication space being segmented into a plurality of smaller cellular spaces, each said cellular communication space for electronic scanning being defined by a plurality of discrete chosen directions corresponding to the said geodesic sphere phased array structure and, each said cellular communication space adapted to be electronically scanned by a plurality of active said contiguous phased subarrays corresponding to the said cellular communication space.

15. The geodesic sphere phased array antenna structure as set forth in claim 14 where each of the hexagonal and pentagonal planar surfaces is further subdivided into planar equilateral triangular surfaces forming pyramidal structures with their common vertices moved radially outwards on to the circumscribing sphere each said equilateral triangular planar surfaces is fitted with subarrays of antenna elements.

16. The geodesic sphere phased array antenna structure as set forth in claim 15 where each of said chosen directions for each said communication space segments corresponds to the direction of a vertex from the center of said geodesic sphere.

17. The geodesic sphere phased array antenna structure in claim 15 where each of the said communication space segment around the direction of a vertex of said geodesic sphere is defined by the adjacent vertices of the said geodesic sphere.

18. The geodesic sphere phased array antenna structure as set forth in claim 14 where said structure is a full geodesic sphere and is deployable as a space based radar and communication satellite.

19. A geodesic sphere phased array antenna system for multi-satellite communications and tracking said antenna system comprising:

a geodesic structure derived from a regular polyhedron having a plurality of planar faces to form a geodesic three dimensional structure with a plurality of said geodesic planar surfaces each said geodesic planar surface having mounted thereon a subarray of planar antenna element units;

transmit and receive signal processing means connected to each said planar antenna element unit of each said subarray for simultaneous transmission and reception of signals;

electromagnetic signal feed means connected to each said planar antenna element unit of each said subarray for forming at least one electromagnetic beam in space;

electronic switching means for selectively connecting each said subarray to adjacent subarrays for generating multiple electromagnetic beams in selective diverse directions in space;

electronic phase shifting means connected to each said planar antenna element unit of each said subarray for providing electronic scanning capability to said subarrays of antenna element units connected by said electronic switching means with the phased array communication space being segmented into a plurality of smaller cellular spaces, each said cellular communication space for electronic scanning being defined by a plurality of discrete chosen directions corresponding to the said geodesic sphere phased array structure and each said cellular communication space is adapted to be electronically scanned by a plurality of active said contiguous phased subarrays corresponding to the said cellular communication space.

20. The geodesic sphere phased array antenna as set forth in claim 19 where the said geodesic structure is derived from any regular polyhedron which is a member of the class of platonic solids that include the tetrahedron, the cube, the octahedron, and the dodecahedron.

21. The geodesic sphere phased array antenna as set forth in claim 19 where each of the said regular planar surfaces of the polyhedron is further subdivided into planar triangular surfaces forming pyramidal structures with their common vertices projected radially outwards on to the circumscribing sphere and each of said triangular planar surfaces is fitted with subarrays of antenna elements.

22. The geodesic sphere phased array antenna structure in claim 19 where each of the said chosen directions for each said cellular communication space segments corresponds to the direction of a vertex of the said geodesic sphere from the center of said sphere.

23. The geodesic sphere phased array antenna as set forth in claim 19 where each of the said cellular communication space segments around the direction of a vertex of the said geodesic sphere from the center of said sphere is defined by the adjacent vertices of the said geodesic sphere.

24. The geodesic sphere phased array antenna as set forth in claim 19 where the said structure is a full geodesic sphere and is deployable as a space based radar and communication satellite.

25. A geodesic sphere phased array antenna system for multi-satellite communications and tracking said antenna system comprising:

a geodesic structure derived from a semi-regular polyhedron having a plurality of planar faces forming a geodesic three dimensional structure a plurality of said geodesic planar surfaces each having mounted thereon a subarray of planar antenna element units;

transmit and receive signal processing means connected to each said planar antenna element unit of each said subarray for simultaneous transmission and reception of signals;

electromagnetic signal feed means connected to each said planar antenna element unit of each said subarray for forming at least one electromagnetic beam in space;

electronic switching means for selectively connecting each said subarray to adjacent subarrays for generating multiple electromagnetic beams in selective diverse directions in space;

electronic phase shifting means connected to each said planar antenna element unit of each said subarray for providing electronic scanning capability to said subarrays of antenna element units connected by said electronic switching means with the phased array communication space being segmented into a plurality of smaller cellular spaces, each said cellular communication space for electronic scanning being defined by a plurality of discrete chosen directions corresponding to the said geodesic sphere phased array structure and each said cellular communication space adapted to be electronically scanned by a plurality of active said contiguous phased subarrays corresponding to the said cellular communication space.

26. The geodesic sphere phased array antenna as set forth in claim 25 where the said geodesic structure is derived from any of the fifteen semi-regular polyhedra which is a member of the class of Archimedian solids that include the truncated tetrahedron, the truncated cube, the truncated octahedron, the truncated dodecahedron, the truncated icosahedron, the semi-regular prism, the rhombicuboctahedron, the semi-regular prismoid, the cuboctahedron, the icosidodecahedron, the snub-cube, the snub-dodecahedron, the rhombicosidodecahedron, the truncated cuboctahedron and the truncated icosidodecahedron.

27. The geodesic sphere phased array antenna as set forth in claim 25 where each of the said regular planar surfaces of the polyhedron is further subdivided into planar triangular surfaces forming pyramidal structures with the said planar surfaces serving as the said pyramidal base with their common vertices projected radially outwards on to the circumscribing sphere, a subarray of planar antenna units mounted on each of said plurality of triangular planar surfaces.

28. The geodesic sphere phased array antenna as set forth in claim 25 where each of the said chosen directions for each said cellular communication space corresponds to the direction of a vertex of the said geodesic sphere from the center of said sphere.

29. The geodesic sphere phased array antenna as set forth in claim 25 where each of the said cellular communication space segments around the direction of a vertex from the center of said geodesic sphere is defined by the adjacent vertices of said geodesic sphere.

30. The geodesic sphere phased array antenna structure in claim 25 where said structure is a full geodesic sphere and is deployable as a space based radar and communication satellite.

* * * * *